US009481972B1

(12) United States Patent
Mullins et al.

(10) Patent No.: US 9,481,972 B1
(45) Date of Patent: Nov. 1, 2016

(54) SYSTEMS AND METHODS FOR SPLICING PILE SEGMENTS

(71) Applicants: Austin Gray Mullins, Bradenton, FL (US); Rajan Sen, Tampa, FL (US); Lawrence Edward Jones, Tallahassee, FL (US)

(72) Inventors: Austin Gray Mullins, Bradenton, FL (US); Rajan Sen, Tampa, FL (US); Lawrence Edward Jones, Tallahassee, FL (US)

(73) Assignee: University of South Florida, Tampa, FL (US)

( * ) Notice: Subject to any disclaimer, the term of this patent is extended or adjusted under 35 U.S.C. 154(b) by 32 days.

(21) Appl. No.: 14/276,585

(22) Filed: May 13, 2014

Related U.S. Application Data

(60) Provisional application No. 61/822,672, filed on May 13, 2013.

(51) Int. Cl.
*E02D 5/52* (2006.01)
*E02D 5/24* (2006.01)

(52) U.S. Cl.
CPC ..... *E02D 5/526* (2013.01); *E02D 5/24* (2013.01)

(58) Field of Classification Search
CPC ..... E02D 5/523; E02D 5/58; E02D 5/30; E02D 5/34; E02D 5/54; E02D 5/105; E02D 5/48; E02D 5/64; E02D 5/526; E02D 5/24; E04B 1/215; E04C 3/34; E04C 3/22; E04C 5/165; F16L 25/0027
See application file for complete search history.

(56) References Cited

U.S. PATENT DOCUMENTS 262,569 A 8/1882 Case
1,024,069 A 4/1912 Francisco
2,430,879 A 11/1947 Kohn
3,382,680 A 9/1965 Takano
3,248,888 A * 5/1966 Williams ..... E02D 5/523 405/232
3,449,918 A 6/1969 Fuentes, Jr.
3,504,501 A 4/1970 Fuentes, Jr.
3,703,748 A * 11/1972 Kelly ..... E04C 5/122 403/368
3,802,206 A * 4/1974 Moore ..... E02D 5/523 403/267
3,934,422 A 1/1976 Fredrickson et al.
4,043,133 A * 8/1977 Yegge ..... E02D 5/58 405/239
4,314,777 A 2/1982 Henderson
4,431,347 A * 2/1984 Gillen, Jr. ..... E02D 5/523 403/306
4,605,340 A 8/1986 Stephan
4,718,209 A * 1/1988 Hansen ..... E04C 5/122 52/223.13
4,900,193 A * 2/1990 MacKinnon ..... E02D 5/523 403/294
5,934,835 A 8/1999 Whitty
7,043,801 B2 * 5/2006 Toimil ..... F16G 11/04 24/136 R
2009/0263189 A9 10/2009 Koivunen
2010/0322717 A1 12/2010 Paul
2011/0002744 A1 1/2011 Tadros et al.

* cited by examiner

*Primary Examiner* — Benjamin Fiorello
*Assistant Examiner* — Carib Oquendo
(74) *Attorney, Agent, or Firm* — Thomas | Horstemeyer, LLP

(57) ABSTRACT

In one embodiment, a pile splicing system and method uses a pile segment adapted to form part of a spliced pile, the pile segment including an elongated concrete body having first and second ends, one-way anchor embedded in the body that is adapted to resist passage of a post-tensioning strand in a direction toward the first end of the body; and a splicing duct embedded in the body that extends from the first end to the embedded one-way anchor.

29 Claims, 9 Drawing Sheets

SYSTEMS AND METHODS FOR SPLICING PILE SEGMENTS

CROSS-REFERENCE TO RELATED APPLICATION(S)

This application claims priority to U.S. Provisional Application Ser. No. 61/822,672, filed May 13, 2013, which is hereby incorporated by reference herein in its entirety.

BACKGROUND

Concrete piles are used to construct foundations for various structures, such as buildings and bridges. The piles are typically cast in a pre-stressed manner, lifted by a crane, and driven into the ground using a drop hammer. In some cases, a pile of the necessary length may be too long and heavy to be lifted by a crane. In such circumstances, a first, shorter pile segment can be driven into the ground and a second pile segment can be spliced to the first pile segment to form a spliced pile having the desired length. The spliced pile can then be driven into the ground in the typical manner.

There are currently several mechanical splices available that are designed to splice pre-stressed pile segments together. While such splices are designed to securely connect the pile segments to each other, the location at which the splices attach to the pile segments are the weakest points of the segments. Specifically, the splices attach to the ends of the pile segments in the "transition zones" at which there is very little pre-stress in the concrete. Although mechanical splices typically comprise reinforcement (e.g., rebar) that is embedded in the ends of the pile segments, this reinforcement is not enough to compensate for the lack of pre-stressing. Because of this, the region of the splice is relatively weak and can only withstand a limited amount of tensile stress during driving. Therefore, the spliced pile cannot be driven with the same force as can a non-spliced pile.

From the above discussion, it can be appreciated that it would be desirable to have a system and method for splicing pile segments that can be used to form spliced piles that can withstand greater forces.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have a system and method that can be used to form spliced piles that can withstand greater forces. Disclosed herein are examples of such systems and methods. In one embodiment, a pile splicing system comprises a dual embedded anchorage design in which one-way anchorages are embedded in the splicing ends of both the upper and lower pile segments. Prior to splicing, post-tensioning strands are passed through the upper pile segment from its bottom end to its top end so as to pass through its embedded anchorages, leaving lengths of strands extending from both ends. The lengths extending from the bottom end of the upper pile segment can then be inserted into the top end of the lower pile segment and through its embedded anchorages. The two pile segments can then be brought into contact together and the post-tensioning strands can be tensioned against the embedded anchorages of both segments to urge the pile segments together and provide compression to the transition zones that increases the resistance of the pile segments to tensile stress.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
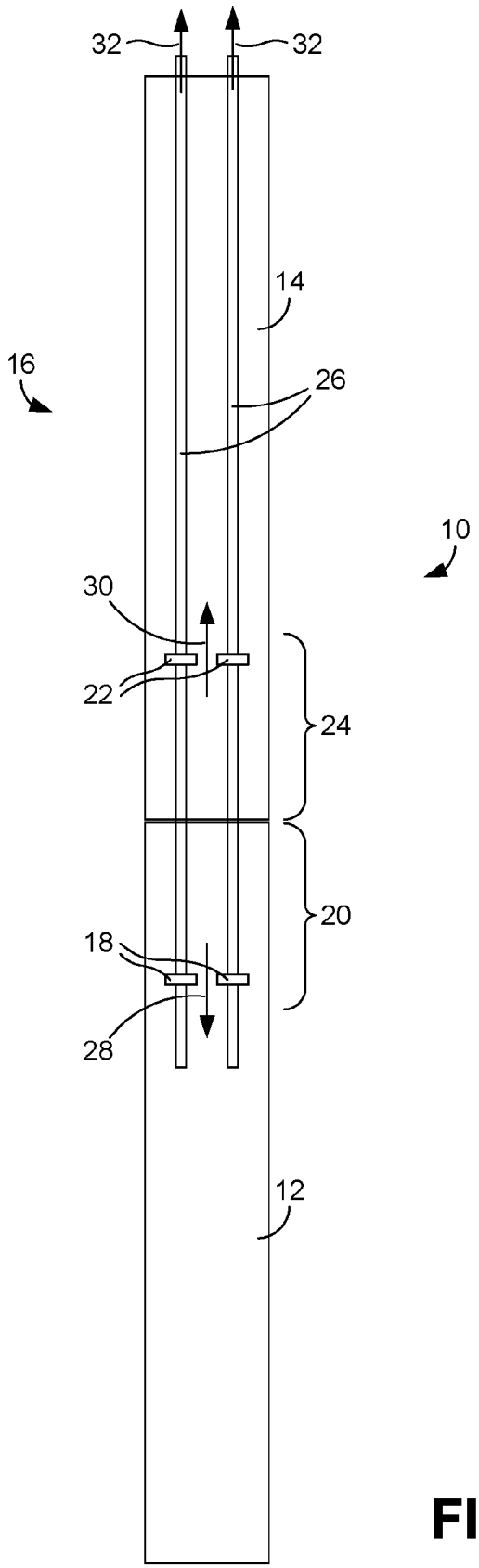
FIG. 1 is a schematic view of an embodiment of a splicing system used to splice two pile segments together.

FIG. 1 schematically illustrates an embodiment of a splicing system 10 that has been used to splice two pile segments together. The pile segments include a lower pile segment 12, which can be independently driven into the ground prior to splicing, and an upper pile segment 14, which is spliced to the lower pile segment to form a spliced pile 16 that can be driven into the ground. Each pile segment 12, 14 is a pre-stressed pile segment that includes a plurality of pre-stressing strands (not shown) that were pre-stressed within the pile form prior to casting. As shown in FIG. 1, one-way anchorages 18 are embedded in a top portion 20 of the lower pile segment 12. In addition, one-way anchorages 22 are embedded in a bottom portion 24 of the upper pile segment 14. These portions 20, 24 are the transition zones of the pre-stressed pile segments 12, 14 in which the pre-stress of the segments is least. In some embodiments, the transition zones are approximately 3 to 5 feet in length.

With further reference to FIG. 1, post-tensioning strands 26 extend through the upper pile segment 14 and its one-way anchorages 22, and into the top portion 20 of the lower pile segment 12 and through its one-way anchorages 18. The anchorages 18 of the lower pile segment 12 are oriented such that the post-tensioning strands 26 can only pass through the anchorages from top to bottom (in the orientation of FIG. 1), as indicated by the arrow 28. In contrast, the one-way anchorages 22 of the upper pile segment 14 are oriented such that the post-tensioning strands 26 can only pass through the anchorages from bottom to top (in the orientation of FIG. 1), as indicated by the arrow 30. With such an arrangement, tensioning of the post-tensioning strands 26 from the top end of the upper pile segment 14 (as indicated by arrows 32)

pulls the top portion 20 of the lower pile segment 12 and the bottom portion 24 of the upper pile segment 14 together to splice the segments and provide post-tensioning to the transition zones that increases their resistance to tensile forces. Accordingly, a hybrid pre-stressing and post-tensioning scheme is used to ensure that the spliced pile can withstand the forces associated with pile driving and later use.

Figure 2:
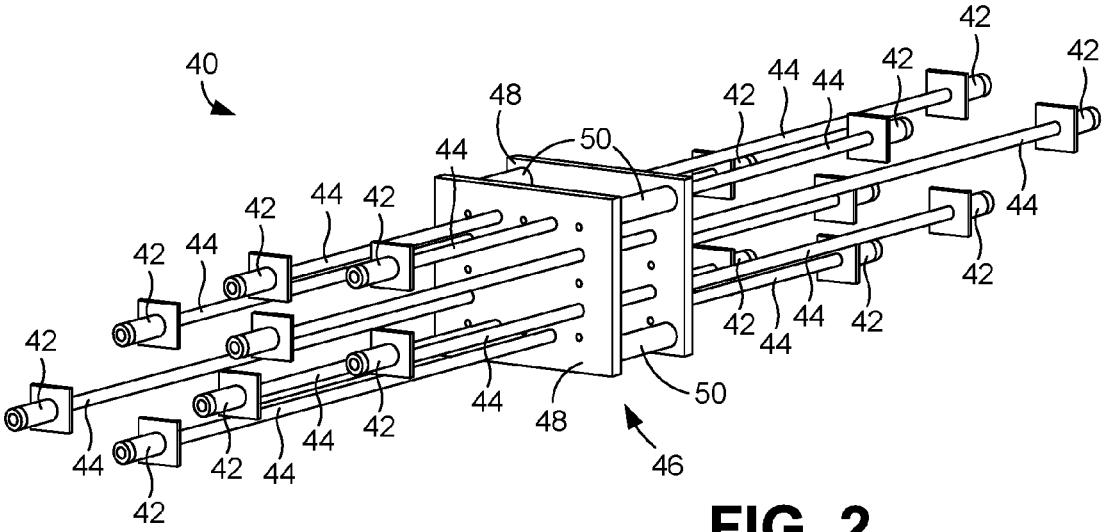
FIG. 2 is a perspective view of an apparatus used to form pile segments having embedded one-way anchorages.

An embodiment of the fabrication of pile segments that can be spliced together using the scheme illustrated in FIG. 1 will now be described. FIG. 2 illustrates apparatus 40 that can be used to embed multiple one-way anchorages 42 and splicing ducts 44 in upper and lower pile segments during casting. In the illustrated embodiment, the apparatus 40 is adapted to form 8 anchorages in each pile segment. As shown in FIG. 2, the apparatus 40 includes a splicing header 46 that is used to separate the upper and lower pile segments in the pile form (see FIG. 4). In the illustrated example, the splicing header 46 comprises two parallel steel plates 48 that are separated from each other by steel pipe sections 50 provided in the corners of the plates. Each of the plates 48 is provided with multiple openings through which post-tensioning strands (not shown) and the splicing ducts 44 can pass. The patterns of the openings provided in the plates 48 match each other so that each splicing duct 44 of the upper pile segment aligns with the splicing duct 44 of the lower pile segment.

In the illustrated example, the splicing ducts 44 comprise continuous lengths of conduit, made of either a metal or polymeric material, that extend through the openings in the splicing header 46 and that connect to a one-way anchorage 42 on each side of the header. In such an arrangement, an anchorage 42 is mounted to each free end of each splicing duct 44. In other embodiments, however, separate splicing ducts 44 can be provided for the anchorages 42 of the upper and lower pile segments, respectively. In such a case, the splicing ducts 44 can be connected to plates 48 on opposite sides of the splicing header 46. When the inner ends of the splicing ducts 44 are threaded, they are adapted to receive threaded caps that can pass through the plates 48 and into the ducts to seal them and prevent the ingress of concrete or other material during and after the casting process (see FIG. 4). In either case, however, each anchorage 42 of each pile segment has a corresponding anchorage within the other pile segment with which it is aligned. Therefore, the anchorages 42 can be said to be arranged in pairs in which one anchorage of the pair is provided in the upper pile segment and the other anchorage of the pair is provided in the lower pile segment.

As is apparent in FIG. 2, the positions of the one-way anchorages 42 are staggered on both sides of the splicing header 46 such that the distances between the anchorages from the splicing header vary on both sides of the header. This results in the anchorages 42 being embedded at different depths within the transition zones of the upper and lower pile segments. In some embodiments, the distance between an anchorage 42 and its corresponding anchorage in the other pile segment is constant for each of anchorages. Accordingly, in cases in which continuous splicing ducts 44 are passed through the splicing header 46 to extend to each pile segment as shown in FIG. 2, the ducts can each have the same approximate length.

Figure 3A:
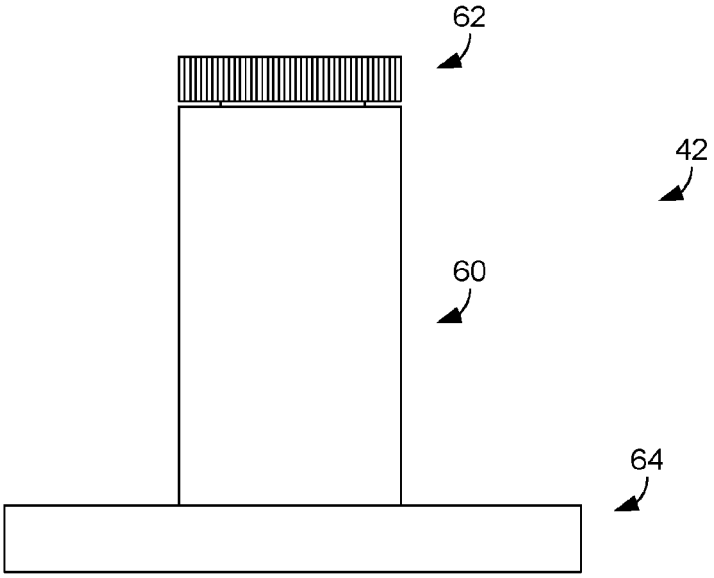
FIG. 3A is a side view of an embodiment of a one-way anchorage used in the apparatus of FIG. 2.
Figure 3B:
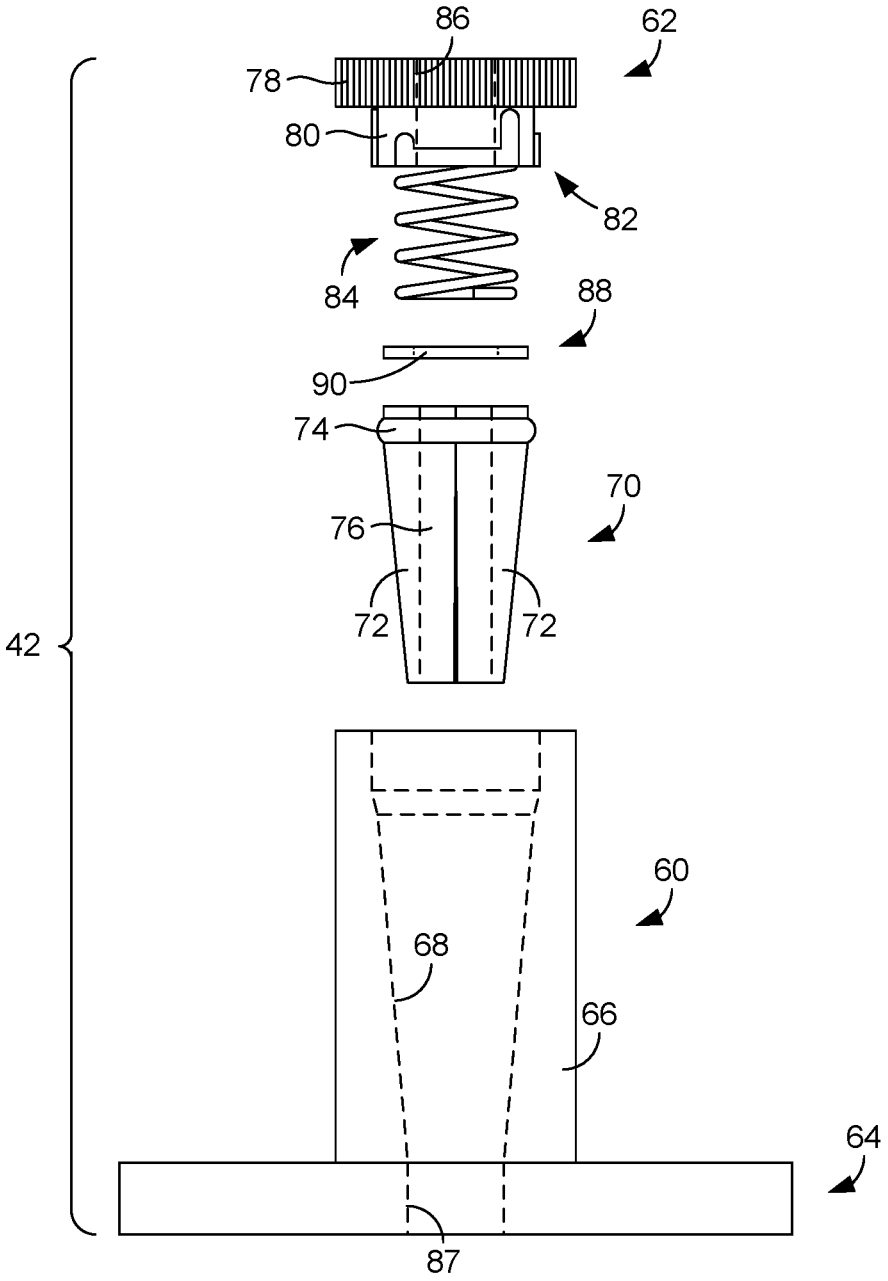
FIG. 3B is an exploded side view of the one-way anchorage of FIG. 3A.

A one-way anchorage 42 is attached to the free distal end(s) of each splicing duct 44. In some embodiments, the anchorages 42 are welded to their associated splicing duct 44. FIGS. 3A and 3B show an example construction for one of the anchorages 42. As indicated in FIG. 3A, the anchorage 42 generally includes a body 60, an end cap 62, and a compression plate 64. As indicated in FIG. 3B, the body 60 comprises a cylindrical member 66, which can be made of a metal material, such as steel. The cylindrical member 66 has an internal frustoconical passage 68 that can be accessed through openings formed in the top and bottom of the member. The passage 68 is adapted to receive a frustoconical wedge 70, which can also be made of a metal material, such as steel. In some embodiments, the wedge 70 comprises multiple (e.g., three) discrete components 72 that are held together at one end by a retaining ring 74, such as a resilient O-ring. Together, the components 72 form the outer frustoconical shape of the wedge 68 and a ribbed inner passage 76 through which a post-tensioning stand can pass.

The end cap 62 can be made of a metal material, such as steel, and comprises an outer portion 78 that is adapted to be gripped by a user and an inner portion 80 that is adapted to fit within the top end of the cylindrical member 66. As indicated in FIG. 3B, the outer portion 78 is knurled to facilitate secure gripping and the inner portion 80 is provided with fastening elements 82 that facilitate fastening of the cap 62 to the cylindrical member 66. In some embodiments, the fastening elements 82 comprise part of a bayonet-type fastening system with which the cap 62 can be releasably secured to the cylindrical member 66, which has complementary fastening elements. As is further shown in FIG. 3B, the cap 62 also includes a coil spring 84 that is adapted to resist insertion of the cap 62 into the cylindrical member 66. In such a case, the cap 62 can be inserted into the cylindrical member 66 against the force of the spring 84, twisted (e.g., clockwise) to lock the cap to the cylindrical member, and released. The cap 62 can then be removed by pressing the cap 62 toward the cylindrical member 66 to compress the spring 84 and twisting the cap in the opposite direction (e.g., counter clockwise) to uncouple the complementary fastening elements. As is further indicated in FIG. 3B, the cap 62 includes a passage 86 through which a post-tensioning strand can be passed.

In some embodiments, the compression plate 64 is a planar steel plate that is welded to the cylindrical member 66. Like the cylindrical member 66, the compression plate 64 comprises a passage 87 through which a post-tensioning strand can be passed. When the one-way anchorage 42 has been embedded within a pile segment and a post-tensioning strand that has been passed through the anchorage is tensioned, the compression plate 64 can apply additional compression load to the concrete.

With further reference to FIG. 3B, the one-way anchorage 42 further comprises a washer 88 that is adapted to be inserted into the cylindrical member 66 between the spring 84 of the end cap 62 and the wedge 70. The washer 88 has a thickness that reduces wedge travel within the cylindrical member 66 after tension has been applied to the post-tensioning strand and therefore reduces wedge setting losses. The washer 88 also has a passage 90 through which the post-tensioning strand can pass.

With the anchorage configuration described above, a post-tensioning strand (e.g., a steel cable) can be passed through the one-way anchorage 42 from bottom to top in the orientation of FIGS. 3A and 3B. Specifically, the post-tensioning strand can enter the anchorage 42 through the compression plate 64 and exit the anchorage through the end cap 62. The anchorage 42, however, will resist movement of the post-tensioning strand in the opposite direction. Accordingly, the post-tensioning strand can be passed through the anchorage 42 in a first direction and the strand can then be tensioned in a second, opposite direction while being securely held by the anchorage.

Figure 4:
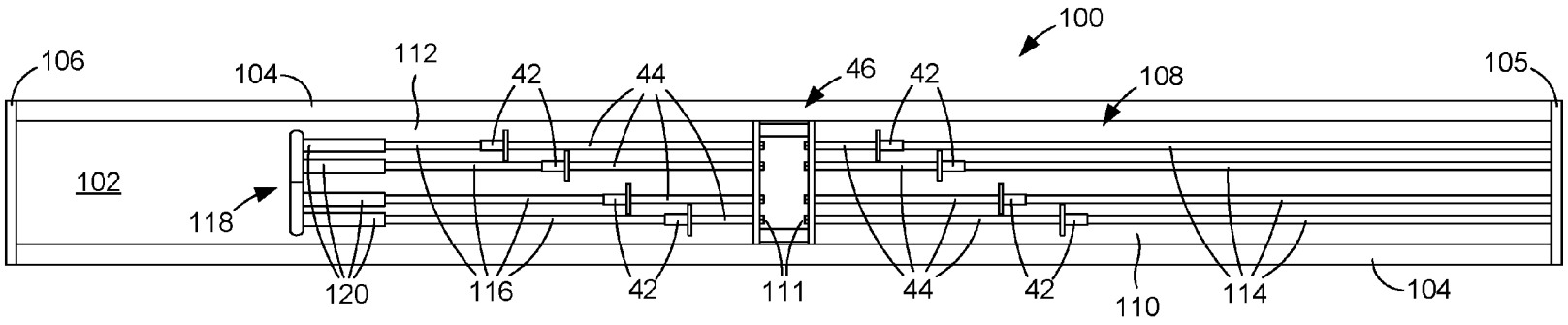
FIG. 4 is a top view of an embodiment of a pile form that is used to cast pile segments that are to be spliced together.

FIG. 4 shows a pile form 100 that can be used to cast both the upper and lower pile segments. As shown in this figure, the form 100 includes a base 102, parallel lateral walls 104, and parallel end plates 105 and 106 that are positioned at the ends of the walls. In some embodiments, the base 102 and walls 104 can be made of concrete and the end plates 105, 106 can be made from steel. Together, the base 102, walls 104, and end plates 105, 106 define an inner space 108 in which concrete can be poured to form the pile segments. While the illustrated pile form 100 is adapted to cast pile segments having a rectangular cross-sections, it is noted that the pile segments can have other configurations. For example, the pile segments can have circular cross-sections if the form were configured to produce such a shape.

As is further shown in FIG. 4, the apparatus 40 of FIG. 2, including the splicing header 46, one-way anchorages 42 (only a few shown for purposes of clarity), and the splicing ducts 44, has been provided within the inner space 108 of the pile form 100. The splicing header 46 is positioned roughly halfway along the length of the form 100 so as to divide its inner space 108 into an upper pile splice section 110 and a lower pile splice section 112. In this example, separate threaded splicing ducts 44 are provided for the upper and lower pile segments. Therefore, caps 111 have been threaded into the ends of the splicing ducts 44. The anchorages 42 are arranged in the upper and lower pile splice sections 110, 112 such that a post-tensioning strand can only pass through the anchorages in a direction away from the splicing header 46. As described below, this facilitates post-tensioning of the transition zones of the pile segments during splicing.

With further reference to FIG. 4, extension ducts 114 have been attached to the free ends of the one-way anchorages 42 in the upper pile splice section 110. The extension ducts 114 comprise lengths of conduit that extend from the anchorages 42 to the end plate 105. In some embodiments, the extension ducts 114 are lengths of metal conduit that are welded to the end caps 62 of the anchorages 42. Together, the extension ducts 114, anchorages 42, and splicing ducts 44 in the upper pile splice section 110 form continuous pathways through which post-tensioning strands can be passed. It is noted that, while the ducts 44, 114 are illustrated as being straight, the ducts can be corrugated, if desired.

Extension ducts 116 have also been attached to the free ends of the one-way anchorages 42 in the lower pile splice section 112. The extension ducts 116 comprise lengths of conduit that extend from the anchorages 42 to a grouting manifold 118 that, as is described below, facilitates grouting of all ducts within the spliced pile. In some embodiments, the grouting manifold is made of a polymeric material, such as poly (vinyl chloride) (PVC). In some embodiments, the extension ducts 114 are lengths of metal conduit that are welded to the anchorages 42 and inserted into tubes 120 of the grouting manifold 118. Together, the splicing ducts 44, anchorages 42, and extension ducts 116 in the lower pile splice section 112 form continuous pathways through which the post-tensioning strands can be passed.

Figure 5:
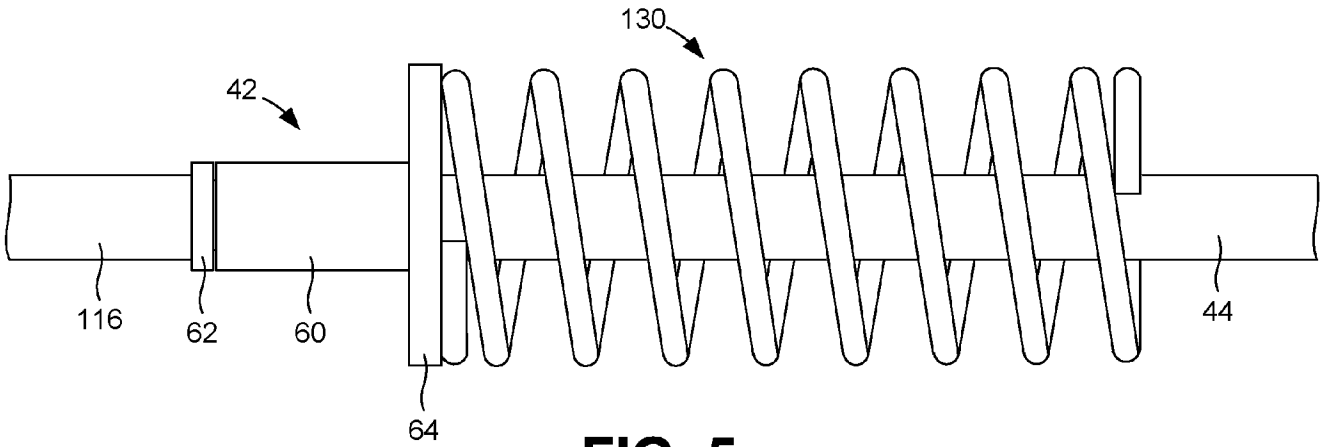
FIG. 5 is a side view of an embodiment of a one-way anchorage having a confinement coil.

In some embodiments, confinement coils can be mounted to the splicing ducts 44 adjacent the compression plates 64 of the one-way anchorages 42 to reinforce the concrete in the region of the anchorages and provide additional compressive capacity. FIG. 5 illustrates an example of this. In particular, FIG. 5 shows an anchorage 42 that is connected to a splicing duct 44 and an extension duct 116. A confinement coil 130 surrounds the portion of the splicing duct 44 next to the compression plate 64 of the anchorage 42, and its ends are secured to the splicing duct. In embodiments in which the splicing duct 44 and the coil 130 are both made of metal, such as steel, the ends of the coil 130 can be welded to the splicing duct. A confinement coil similar to that shown in FIG. 5 can be provided for each one-way anchorage 42 in the pile form 100 if the additional reinforcement the coils provide is deemed necessary.

With reference back to FIG. 4, the pile segments that are to be cast using the pile form 100 are pre-tensioned pile segments. Therefore, pre-tensioning strands (not shown for purposes of clarity) are provided in the pile form 100 prior to casting. In particular, the strands are passed through the end plates 105, 106 and the splicing header 46. By way of example, 8 pre-tensioning strands can be provided in the pile form 100. In embodiments in which the pile segments will comprise an equal number of anchorages 42 and pre-tensioning strands, the splicing ducts 44 and the pre-tensioning strands can be arranged in an alternating manner in which a strand is positioned between adjacent pairs of splicing ducts and vice versa. Regardless of the arrangement of the pre-tensioning strands, the strands can be tensioned prior to curing of the concrete using an appropriate apparatus, such as a jack. By way of example, the pre-tensioning strands can be tensioned to approximately 75 to 80% of the ultimate steel strength so as to provide approximately 1,000 psi of compressive force to the pile segments outside of the transition zones.

Once the pile form 100 has been prepared in the manner described above, concrete can be poured in the upper and lower pile segment sections 110, 112 to form the upper and lower pile segments. After the concrete has cured to an acceptable degree, the ends of the pre-tensioning strands extending from the ends of the cast pile segments can be cut to compress the pile segments. In addition, the portions of the splicing ducts 44 that extend from the pile segments can be cut. When this is performed, the bottom end of the upper pile segment and the top end of the lower pile segment will be substantially flat and prepared for mating.

Figure 6:
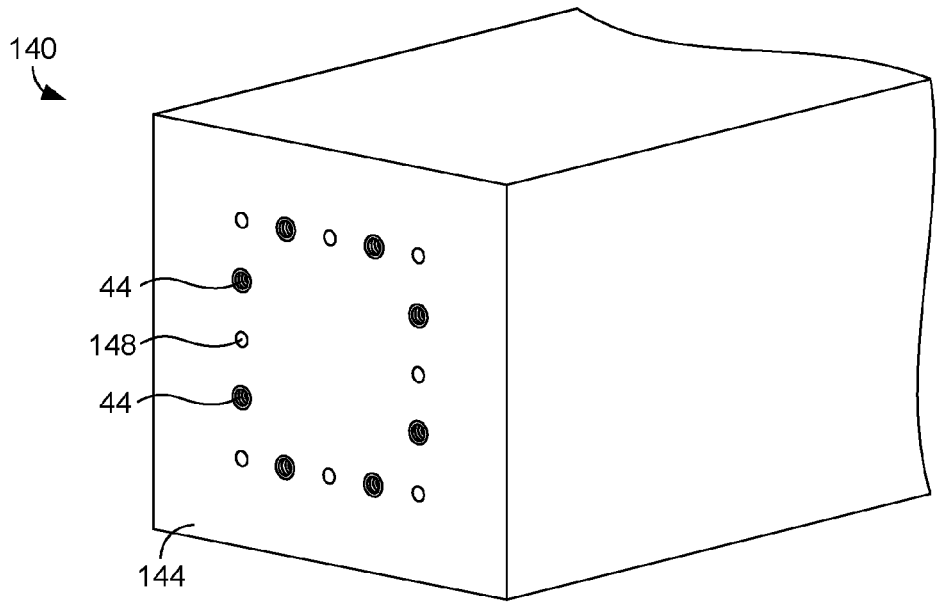
FIG. 6 is a perspective view of a bottom end of an embodiment of an upper pile segment after casting.
Figure 7:
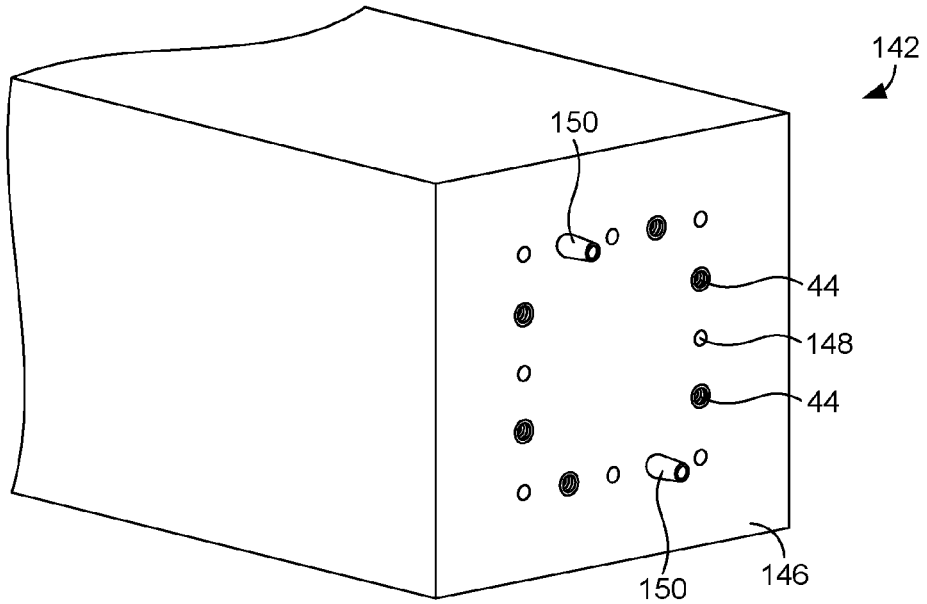
FIG. 7 is a perspective view of a top end of an embodiment of a lower pile segment after casting.

FIGS. 6 and 7 respectively illustrate the bottom end of an upper pile segment 140 and the top end of a lower pile segment 142 that were cast using the pile form 100. More particularly, shown in the figures are a bottom (splicing) surface 144 of the upper pile segment 140 and a top (splicing) surface 146 of the lower pile segment 142. As shown in the figures, the splicing ducts 44 and the pre-tensioning strands 148 together trace the outline of a rectangle in which a pre-tensioning strand 148 is positioned between each adjacent splicing duct 44 and vice versa to form the alternating pattern described above. As mentioned above, the splicing ducts 44 of the lower pile segment 142 can be threaded so as to be adapted to receive threaded caps that prevent the ingress of concrete or other materials during and after casting. When these caps are removed, frustoconical alignment elements 150 can be threaded into the splicing ducts 44. In addition to facilitating alignment of the upper and lower pile segments 140, 142 during splicing, the alignment elements 150 prevent adhesive material, such as epoxy, that is applied to the surfaces 144, 146 of the segments from entering, and possibly clogging, the splicing ducts 44. In some embodiments, the alignment elements 150 are made of metal, such as steel.

Figure 8:
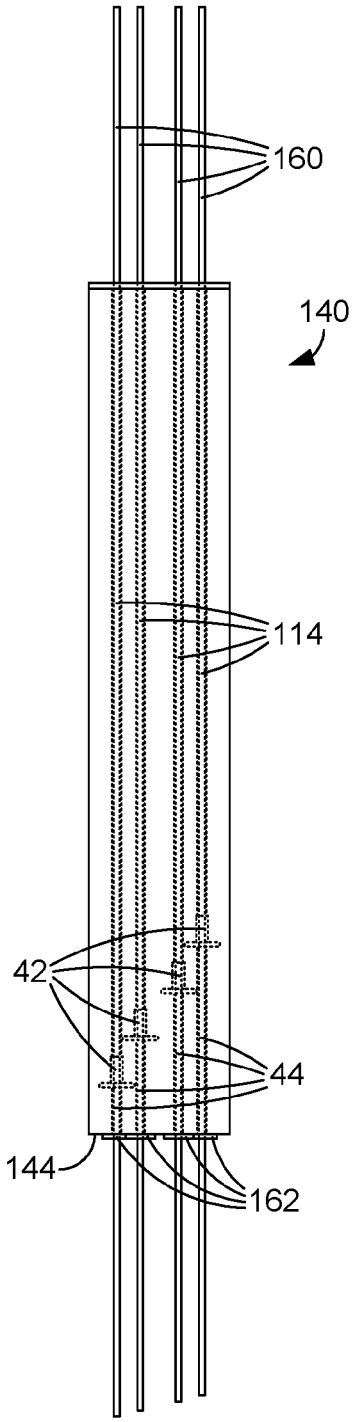
FIG. 8 is a side view of an upper pile segment prior to splicing.
Figure 9:
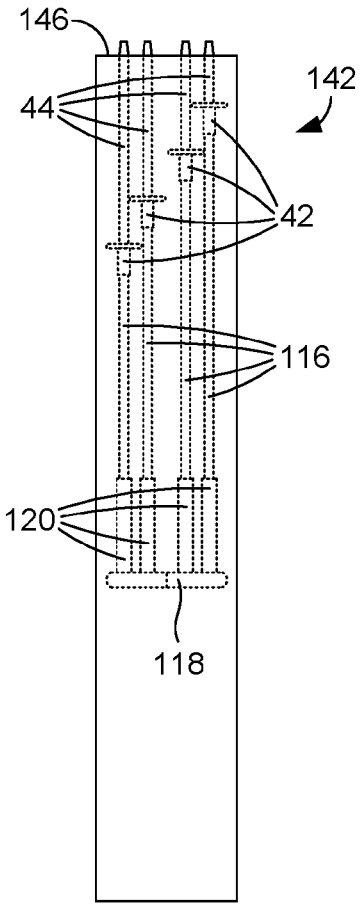
FIG. 9 is a side view of a lower pile segment prior to splicing.

FIG. 8 shows the cast upper pile segment 140 and FIG. 9 shows the cast lower pile segment 142 prior to splicing. As indicated in FIG. 8, embedded in the upper pile segment 140 are the one-way anchorages 42, the splicing ducts 44, and the extension ducts 114. The anchorages 42 are arranged in the upper pile segment 140 such that they will resist movement of a post-tensioning strand in a direction toward the bottom surface 144 of the segment. As indicated in FIG. 9, embedded in the lower pile segment 142 are the one-way anchorages 42, the splicing ducts 44, the extension ducts 116, and the grout manifold 118. The anchorages 42 are arranged in the lower pile segment 142 such that they will resist movement of a post-tensioning strand in a direction toward the top surface 144 of the segment.

As is further shown in FIG. 8, post-tensioning strands 160 have been passed through the upper pile segment 140 in preparation for splicing. More particularly, the strands 160 have been passed through the splicing ducts 44 at the bottom end of the upper pile segment 140, through the anchorages 42, and through the extension ducts 116 so as to emerge from the top end of the segment. As indicated in FIG. 8, each strand 160 extends from each end of the upper pile segment 140. By way of example, a few feet of strand 160 extends from each end. The lengths of strand 160 that extend from the bottom end of the upper pile segment 140 are available for insertion into the splicing ducts and anchorages of the lower pile segment 142 while the lengths of strand that extend from the top end of the upper pile segment facilitate tensioning of the strands. In some embodiments, the lengths of strand 160 that extend from the bottom end of the upper pile segment can have different lengths so as to enable sequential insertion of the strands into the lower pile segment 142.

As is further shown in FIG. 8, clamps 162 can be applied to the post-tensioning strands 160 at the bottom end of the upper pile segment 140 to prevent the strands from passing further into the segment during splicing. In addition, an end plate 164 can be provided at the top end of the upper pile segment 140 to facilitate tensioning of the post-tensioning strands 160.

Figure 10A:
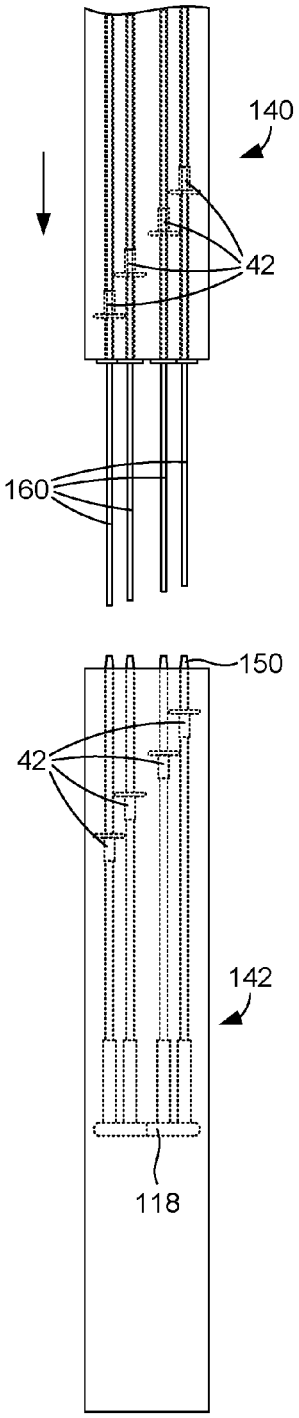
FIGS. 10A-10C are sequential side views illustrating splicing of the upper pile segment of FIG. 8 to the lower pile segment of FIG. 9.
Figure 10B:
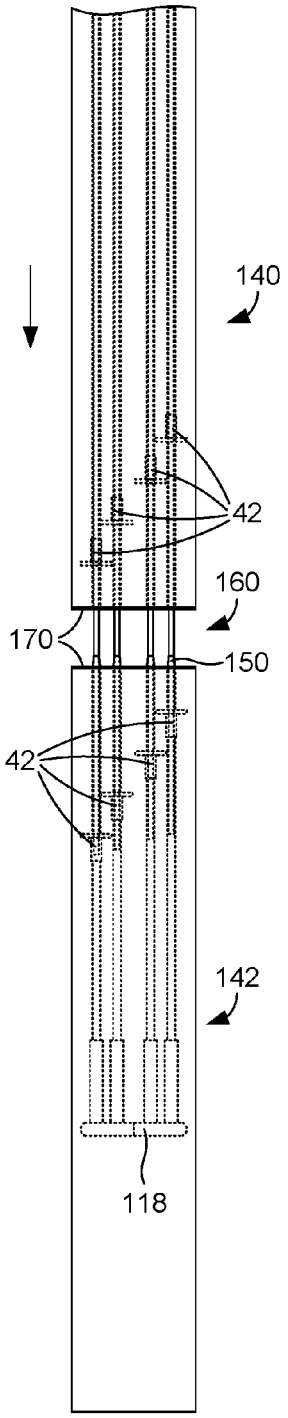
Figure 10C:
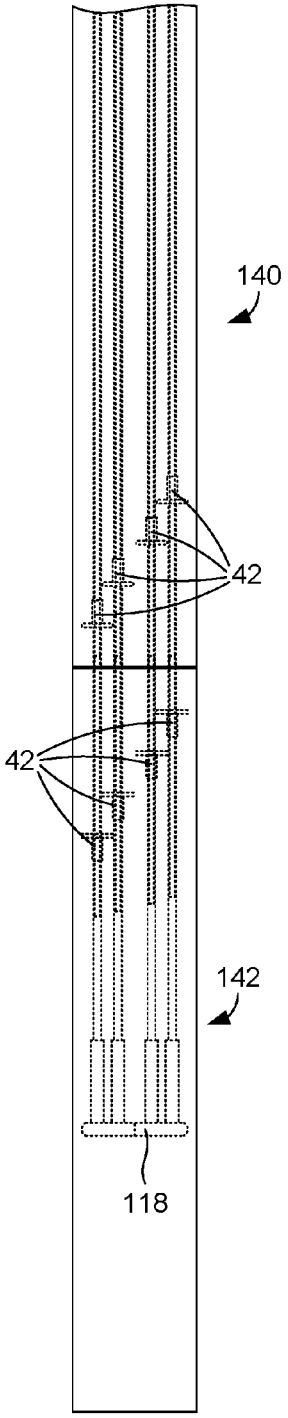

FIGS. 10A-10C illustrate various steps of an example pile splicing procedure. Beginning with FIG. 10A, the lower pile segment 142 can have been driven into the ground using an appropriate piece of equipment, such as a drop hammer. Once driven to a desired depth, the alignment elements 150 described in relation to FIG. 7 can be threaded into the splicing ducts 44 of the lower pile segment 142. At this point, the upper pile segment 140 can be lifted by a crane and lowered toward the lower pile segment 142.

Referring next to FIG. 10B, the upper pile segment 140 has been lowered farther and the post-tensioning strands 160 have been inserted into the splicing ducts 44 of the lower pile segment 142 through the alignment elements 150. In cases in which the lengths of the post-tensioning strands 160 extending from the upper pile segment 140 are different, the strands can be passed into the lower pile segment 142 in a sequence from longest to shortest instead of having to align each strand with its corresponding splicing duct 44 simultaneously. Before lowering the upper pile segment material 140 down to the point at which it contacts the lower pile segment 142, adhesive material 170, such as epoxy, can be applied to the bottom surface 144 of the upper pile segment and the top surface 146 of the lower pile segment. Because of the presence of the alignment elements 150, the adhesive material 170 does not flow into the splicing ducts 44 of the lower pile segment 142.

Referring next to FIG. 10C, the upper pile segment 140 has been lowered into contact with the lower pile segment 142. As indicated in this figure, each of the post-tensioning strands 160 has been received by a one-way anchorage 42 of the lower pile segment 142. At this point, the adhesive material 170 can be permitted to cure and the post-tensioning strands 160 can be tensioned. In some embodiments, the post-tensioning strands 160 can be tensioned using a jack that is positioned at the top end of the upper pile segment 140. The jack can be placed in contact with the end plate 164 (FIG. 8) and used to pull the post-tensioning strands upward. As the post-tensioning strands 160 are pulled in this manner, they pull upward on the anchorages 42 of the lower pile segment 142, which will not allow the post-tensioning strands 160 also to pass in this direction. This causes the transition zones of the upper and lower pile segments 140, 142 to be compressed. Pulling of the post-tensioning strands 160 also causes the strands to pass through the anchorages 42 of the upper pile segment 140. Because these anchorages 42 only permit travel of the post-tensioning strands 160 in that direction, the transition zones of the upper and lower pile segments 140, 142 remain in compression after the strands have been released from the jack.

Figure 11:
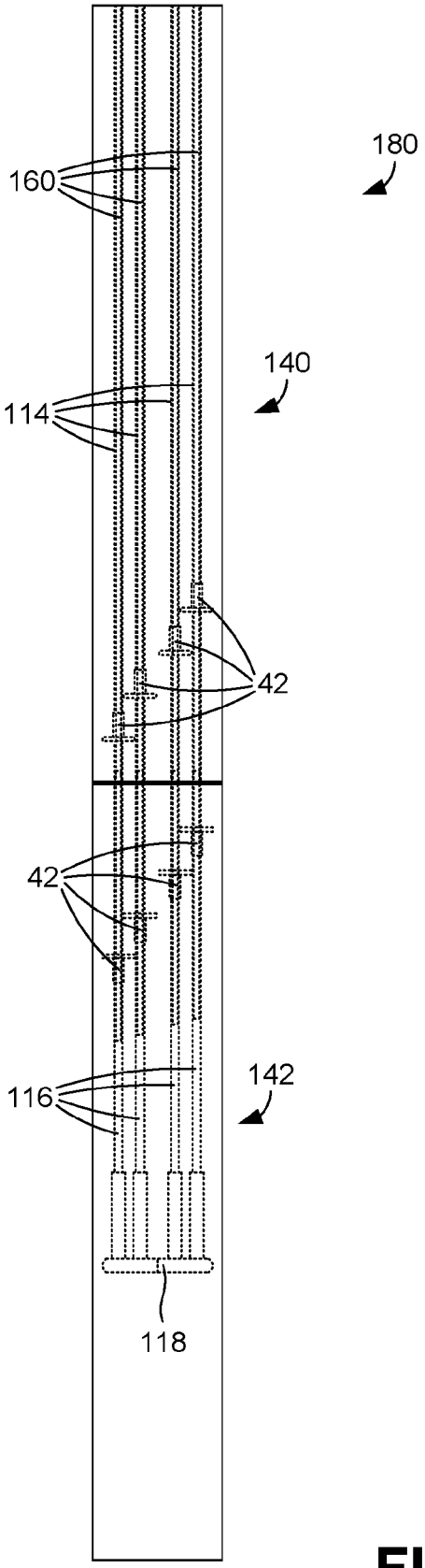
FIG. 11 is a side view of a spliced pile.

After the post-tensioning strands 160 have been tensioned in the manner described above, a spliced pile 180 results (FIG. 11) whose splicing ends (i.e., the ends of the segments 140, 142 adjacent the splicing point) have been compressed to a degree similar to that which the central regions of the segments were pre-stressed. By way of example, the splicing ends can be compressed to approximately 1,000 psi. Therefore, the transition zones near the splicing point can withstand much greater tensile stresses than can conventional spliced piles. While the spliced pile 180 and its segments 140, 142 shown in FIG. 11 are relatively short, it is noted that they can be much longer. For example, each segment 140, 142 of the pile 180 can be as long as approximately 150 feet, if needed for a particular application.

At some point during the splicing procedure, grout can be poured or pumped into one or more of the extension ducts 114 of the upper pile segment 140 to protect the post-tensioning strands 160 from corrosion. In some embodiments, the grout can be pumped after tensioning of the post-tensioning strands 160. Because of the presence of the grout manifold 118 in the lower pile segment 142, the grout will fill each duct and anchorage of both pile segments.

While the splicing scheme described in the foregoing is beneficial, it is noted that other splicing schemes can be used. FIGS. 12A-12D illustrate some examples. Beginning with FIG. 12A, an upper pile segment 190 is spliced to a lower pile segment 192 with post-tensioning strands 194. As indicated in the figure, the post-tensioning strands 194 extend through external one-way anchorages 196 that are provided at the ends of the transition zones of the pile segments 190, 192. Once the post-tensioning strands 194 are tensioned, a spliced pile results that has characteristics similar to those of the spliced pile 180 described above in relation to FIG. 11.

Figures 12A, 12B, 12C, 12D:
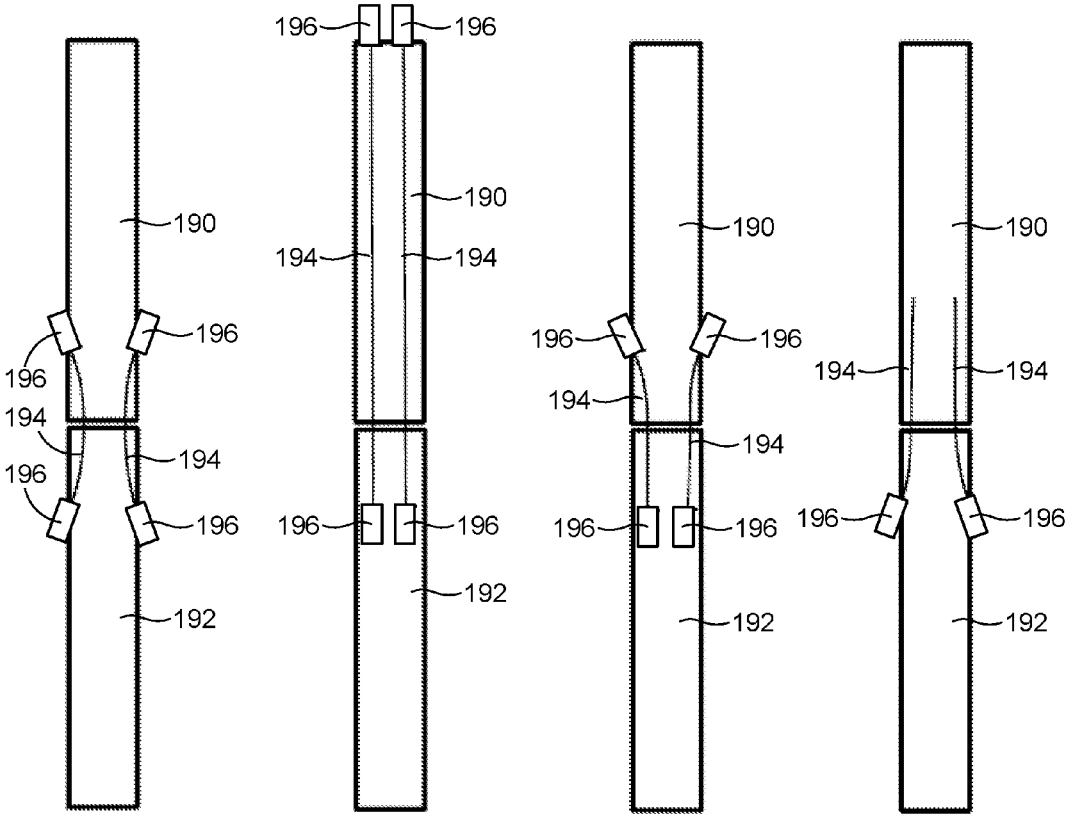
FIGS. 12A-12D are schematic views of alternative splicing systems.

Turning to FIG. 12B, an upper pile segment 190 is spliced to a lower pile segment 192 with post-tensioning strands 194 that extend through the upper pile segment from top to bottom and into one-way anchorages 196 embedded within the lower pile segment. Once the post-tensioning strands 194 are tensioned at the top end of the upper pile segment 190, the transition zone of the lower pile segment 192 and the entire length of the upper pile segment are compressed by the strands.

Referring next to FIG. 12C, an upper pile segment 190 is spliced to a lower pile segment 192 with post-tensioning strands 194. The post-tensioning strands 194 extend through external one-way anchorages 196 of the upper pile segment 190 and through embedded one-way anchorages of the lower pile segment 192. In this case, a spliced pile results that has characteristics similar to those of the spliced pile 180 described above in relation to FIG. 11.

Finally, with reference to FIG. 12D, an upper pile segment 190 is spliced to a lower pile segment 192 with post-tensioning strands 194 that are secured to the upper pile segment with adhesive material (e.g., epoxy) and secured to the lower pile segment 192 with external one-way anchorages 196 that are provided at the ends of the transition zones of the lower pile segment.

As an alternative to the schemes shown in FIGS. 12A-12D, the ends of the post-tensioning strands 194 can be secured to the lower pile segment 192 with adhesive material. For example, if it is determined after driving the lower pile segment 192 into the ground that a longer pile is needed (i.e., splicing was not planned when the lower pile segment was driven into the ground), the lower pile segment can be cored to provide passages through which the post-tensioning strands extending from the upper pile segment 190 can be passed. Epoxy can then be poured into the passages to secure the post-tensioning strands in place within the lower pile segment 192.

The invention claimed is:

1. A system for splicing pile segments comprising:

a splicing header having two sides and being adapted to divide a pile form into an upper pile segment section and a lower pile segment section, wherein the upper pile segment section is adapted to receive concrete that will form an upper pile segment and the lower pile segment section is adapted to receive concrete that will form a lower pile segment;

a plurality of splicing ducts that extend from both sides of the splicing header so as to be adapted to be embedded in the concrete of both the upper and lower pile segments; and a plurality of one-way anchorages attached to free ends of the splicing ducts such that the splicing ducts are positioned between the anchorages and the splicing header and the one-way anchorages are spaced away from the splicing header so as to be adapted to be embedded in the concrete of both the upper and lower pile segments, wherein the anchorages are adapted to resist passage of a post-tensioning strand in a direction toward the splicing header.

2. The system of claim 1, wherein the splicing header includes a plate having openings adapted to receive the splicing ducts and pre-stressing strands.

3. The system of claim 1, wherein the splicing header includes two parallel plates, each having openings adapted to receive the splicing ducts and pre-stressing strands, wherein the openings of the plates are aligned with each other.

4. The system of claim 1, wherein ends of the splicing ducts adjacent the splicing header are threaded.

5. The system of claim 4, further comprising threaded caps that can be passed through the openings in the splicing header and threaded into the splicing ducts.

6. The system of claim 1, wherein the splicing ducts are made of metal and the anchorages are welded to the free ends of the splicing ducts.

7. The system of claim 1, wherein the one-way anchorages include a body having an end cap at one end and a compression plate at another end.

8. The system of claim 7, wherein the one-way anchorages further include a frustoconical wedge provided within a frustoconical passage of the body.

9. The system of claim 8, wherein the end caps include a spring that extends toward the wedge.

10. The system of claim 9, wherein the one-way anchorages further include washers positioned between the spring and the wedge that has a thickness that reduces wedge travel within the body.

11. The system of claim 1, further comprising a plurality of extension ducts, one extension duct extending from each one-way anchorage in a direction away from the splicing header, wherein the splicing ducts, anchorages, and extension ducts on both sides of the header form continuous pathways through which post-tensioning strands can pass.

12. The system of claim 11, further comprising a pile form in which the splicing header, one-way anchorages, and ducts are provided, the pile form and the splicing header together defining the upper pile segment section and the lower pile segment section.

13. The system of claim 12, wherein the extension ducts provided in the upper pile segment section extend to an end of the upper pile segment section while the extension ducts provided in the lower pile segment section do not extend to an end of the lower pile segment section.

14. The system of claim 13, further comprising a grouting manifold that is attached to free ends of the extension ducts provided in the lower pile segment section.

15. A pile segment adapted to form part of a spliced pile, the pile segment comprising:

an elongated concrete body having first and second ends;

a one-way anchor embedded in the body that is adapted to enable a post-tensioning strand to pass through the anchor in only one direction, the anchor being adapted to resist passage of the post-tensioning strand in a direction toward the first end of the body; and a splicing duct embedded in the body that extends from the first end to the embedded one-way anchor.

16. The pile segment of claim 15, further comprising pre-stressed strands embedded in the concrete body that extend along its length.

17. The pile segment of claim 15, wherein the one-way anchor is embedded in the concrete body within a distance of approximately 3 to 5 feet of the first end.

18. The pile segment of claim 15, wherein an end of the splicing duct at the first end of the concrete body is threaded so as to be adapted to receive a threaded element.

19. The pile segment of claim 15, further comprising an extension duct embedded in the concrete body that extends from the one-way anchorage to the second end of the concrete body.

20. The pile segment of claim 15, further comprising an extension duct embedded in the concrete body that extends from the one-way anchorage to a point between the anchorage and the second end of the concrete body.

21. A spliced pile comprising:

a lower pile segment including an elongated concrete body having a top end, a one-way anchor embedded in the body that is adapted to enable a post-tensioning strand to pass through the anchor in only one direction, the anchor being adapted to resist passage of a post-tensioning strand in a direction toward the top end, and a splicing duct embedded in the body that extends from the top end to the embedded one-way anchor;

an upper pile segment including an elongated concrete body having a bottom end, a one-way anchor embedded in the body that is adapted to enable a post-tensioning strand to pass through the anchor in only one direction, the anchor being adapted to resist passage of a post-tensioning strand in a direction toward the bottom end, and a splicing duct embedded in the body that extends from the bottom end to the embedded one-way anchor; and a post-tensioning strand that extends from the one-way anchorage embedded in the lower pile segment to the one-way anchorage embedded in the upper pile segment;

wherein the bottom end of the upper pile segment contacts the top end of the lower pile segment at a splice point.

22. The spliced pile of claim 21, wherein the lower and upper pile segments further comprise pre-stressed strands embedded in the concrete body that extend along its length.

23. The spliced pile of claim 21, wherein the one-way anchors are embedded in the lower and upper pile segments within approximately 5 feet of the splice point.

24. The spliced pile of claim 21, wherein the ends of the splicing ducts at the splice point are threaded so as to be adapted to receive a threaded element.

25. The spliced pile of claim 21, further comprising an extension duct embedded in the concrete body of the lower pile segment that extends from the one-way anchorage to a point between the anchorage and a bottom end of the concrete body.

26. The spliced pile of claim 21, further comprising an extension duct embedded in the concrete body of the upper pile segment that extends from the one-way anchorage to a top end of the concrete body.

27. The spliced pile of claim 21, further comprising epoxy provided at the splice joint between the pile segments.

28. A method for splicing pile segments, the method comprising:

extending post-tensioning strands through ducts and one-way anchorages embedded an upper pile segment in a manner in which ends of the strands extend from a bottom end of the upper pile segment;

lowering the upper pile segment onto a lower pile segment so as to pass the ends of the strands extending from the bottom end of the upper pile segment through ducts and one-way anchorages embedded in the lower pile segment; and tensioning the post-tensioning strands so as to urge the top end of the lower pile segment and the bottom end of the upper pile segment toward each other.

29. The method of claim 28, further comprising applying glue to one or both of the bottom surface of the upper pile segment and the top surface of the lower pile segment before the upper pile segment rests on the lower pile segment.

* * * * *